US011691847B2

(12) United States Patent
Duke et al.

(10) Patent No.: US 11,691,847 B2
(45) Date of Patent: Jul. 4, 2023

(54) ELEVATOR TRAVEL BLOCKING APPARATUS

(71) Applicant: TK Elevator Corporation, Alpharetta, GA (US)

(72) Inventors: Russell Duke, Lakeland, TN (US); Alan Parker, Byhalia, MS (US); Malcom Ray Nooner, Walnut, MS (US)

(73) Assignee: TK Elevator Corporation, Alpharetta, GA (US)

( * ) Notice: Subject to any disclaimer, the term of this patent is extended or adjusted under 35 U.S.C. 154(b) by 55 days.

(21) Appl. No.: 16/876,504

(22) Filed: May 18, 2020

(65) Prior Publication Data

US 2020/0399094 A1 Dec. 24, 2020

Related U.S. Application Data

(60) Provisional application No. 62/864,135, filed on Jun. 20, 2019.

(51) Int. Cl.
*B66B 5/00* (2006.01)

(52) U.S. Cl.
CPC ..... *B66B 5/0062* (2013.01)

(58) Field of Classification Search
CPC ... B66B 5/0031; B66B 5/0087; B66B 5/0025; B66B 9/003; B66B 5/005; B66B 5/0056; B66B 11/0045; B66B 11/0206; B66B 1/36; B66B 5/28; B66B 5/282; B66B 11/0246; B66B 5/00; B66B 5/0062
See application file for complete search history.

(56) References Cited

U.S. PATENT DOCUMENTS

| | | | | |
|---|---|---|---|---|
| 5,727,657 | A | 3/1998 | Foelix | |
| 5,773,771 | A | 6/1998 | Chatham | |
| 5,806,633 | A | 9/1998 | Macuga | |
| 6,095,288 | A | 8/2000 | Rivera | |
| 6,138,798 | A | 10/2000 | Macuga | |
| 6,736,242 | B2 | 5/2004 | Nygren | |
| 7,077,243 | B2 | 7/2006 | Huber | |
| 7,249,656 | B2 | 7/2007 | Huber | |
| 7,258,202 | B1 * | 8/2007 | Rossignol | B66B 17/34 187/351 |
| 7,322,445 | B2 * | 1/2008 | Kocher | B66B 5/0056 187/362 |
| 7,832,526 | B2 | 11/2010 | Sirigu | |
| 7,886,879 | B2 | 2/2011 | Kocher | |
| 8,708,106 | B2 | 4/2014 | Räsänen | |

(Continued)

FOREIGN PATENT DOCUMENTS

| | | | |
|---|---|---|---|
| CA | 2467675 | C | 11/2004 |
| CA | 2166841 | C | 8/2006 |

(Continued)

*Primary Examiner* — Marlon T Fletcher
(74) *Attorney, Agent, or Firm* — Dinsmore & Shohl LLP

(57) ABSTRACT

A travel blocking apparatus for blocking the movement of a car movably disposed in a hoistway. The travel blocking apparatus includes a flapper mechanism attached to the car and configured, when deployed, to extend an arm outside of an outer side periphery of the car and a prop device disposed in the hoistway and configured to contact the arm when said arm is extended so as to stop the car from moving downwardly in the hoistway.

18 Claims, 10 Drawing Sheets

(56) References Cited

U.S. PATENT DOCUMENTS

| | | | | |
|---|---|---|---|---|
| 9,878,877 | B2 * | 1/2018 | Pursiainen | B66B 5/0075 |
| 2006/0042883 | A1 | 3/2006 | Scott | |
| 2007/0205058 | A1 | 9/2007 | Caballero | |
| 2008/0302612 | A1 | 12/2008 | Beauchaud | |
| 2011/0290591 | A1 * | 12/2011 | Spirgi | B66B 5/0087 187/247 |
| 2018/0127237 | A1 * | 5/2018 | Fonteneau | B66B 5/0087 |
| 2018/0244494 | A1 * | 8/2018 | Talonen | B66B 5/0056 |
| 2018/0251340 | A1 * | 9/2018 | Fauconnet | B66B 5/288 |
| 2019/0241399 | A1 * | 8/2019 | Kattainen | B66B 5/005 |
| 2020/0048040 | A1 * | 2/2020 | Fauconnet | B66B 5/18 |
| 2020/0071129 | A1 * | 3/2020 | Ruhnke | B66B 9/00 |

FOREIGN PATENT DOCUMENTS

| | | | |
|---|---|---|---|
| CA | 2467673 | C | 10/2011 |
| CA | 2462296 | C | 3/2012 |
| CA | 2506643 | C | 3/2013 |
| CH | 667638 | A | 10/1988 |
| CN | 103145016 | B | 10/2015 |
| CN | 105110135 | A | 12/2015 |
| DE | 10065099 | A | 7/2002 |
| EP | 2488435 | B | 6/2013 |
| EP | 1343712 | B | 5/2014 |
| EP | 3470355 | A | 4/2019 |
| GB | 2476704 | A | 7/2011 |
| JP | 3056378 | A | 3/1991 |
| JP | 8002849 | A | 1/1996 |
| JP | 2006131338 | A | 5/2006 |
| JP | 2011153012 | A | 8/2011 |
| JP | 5201647 | B | 6/2013 |
| WO | 2002096791 | A | 12/2002 |

* cited by examiner

ELEVATOR TRAVEL BLOCKING APPARATUS

CROSS-REFERENCE TO PRIOR APPLICATIONS

This application claims benefit to U.S. Provisional Patent Application No. 62/864,135, filed on Jun. 20, 2019, the entire disclosure of which is hereby incorporated by reference herein.

FIELD

The present invention relates to the operation of an elevator system and, more particularly, to an apparatus for blocking travel of an elevator car when, for example, the elevator system is being maintained or inspected.

BACKGROUND

Working spaces in elevator shafts or hoistways include, for example, shaft pits and shaft heads. Temporary occupation of such working spaces by persons is required for periodic maintenance and checking of elevator equipment. Relevant regulations, proposed for the protection of the persons temporarily located in these working spaces, address safety for personnel working therein and typically require, for example, that safety systems are deployed before personnel enter into the elevator pit.

There is a need for safety systems that are simple to deploy and reliable. The present invention satisfies the need.

SUMMARY

In one aspect, the present invention includes a travel blocking apparatus for blocking the movement of a car movably disposed in a hoistway. The travel blocking apparatus includes a flapper mechanism attached to the car and configured, when deployed, to extend an arm outside of an outer side periphery of the car and a prop device disposed in the hoistway and configured to contact the arm when said arm is extended so as to stop the car from moving downwardly in the hoistway.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

For purposes of the description hereinafter, the terms "upper, lower, right, left, vertical, horizontal, top, bottom, lateral, longitudinal" and other terms of orientation or position and derivatives thereof, shall relate to the invention as it is depicted in the figures or as elevator structures are conventionally oriented installed and/or in operation. The term "configured" or "configuration" will be understood as referring to a structural size and/or shape. However, it is to be understood that the invention may assume alternative variations and step sequences, except where expressly specified to the contrary. It is also to be understood that the specific systems and processes illustrated in the attached drawings, and described in the following specification, are simply exemplary examples of the invention. Hence, specific dimensions and other physical characteristics related to the examples disclosed herein are not to be considered as limiting.

Figure 1:
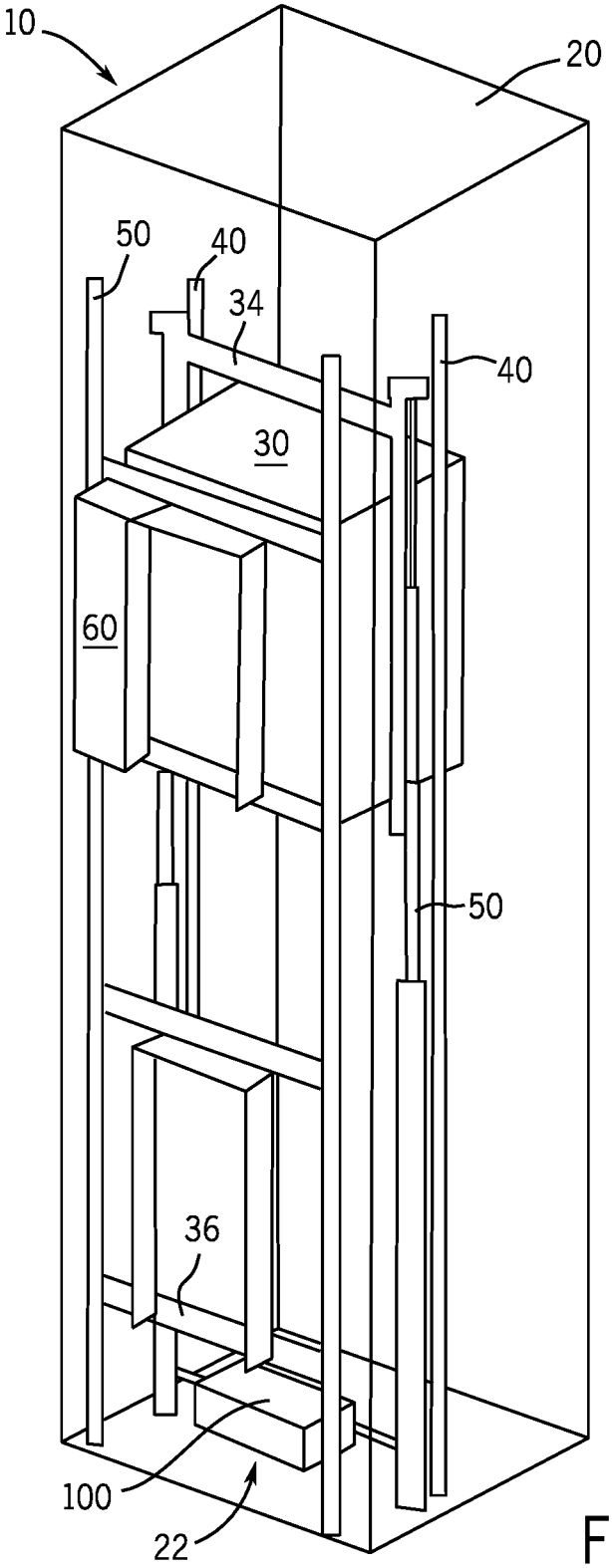
FIG. 1 is an illustration of an elevator system and associated structures.

Turning to the figures, FIG. 1 depicts, schematically, a state-of-the-art hydraulic elevator system 10. The hydraulic elevator system 10 comprises a hoistway 20, an elevator car 30, an elevator car frame 34, guide rails 40, hydraulic jacks 50, a controller mounted in a control cabinet 60, and a power unit 100. The elevator car 30 is guided and along the guide rails 40 via the elevator car frame 34 and operation of the power unit 100 according to signals generated by the controller as is well known.

Hoistway 20 provides a space through which elevator car 30 can be vertically translated along guide rails 40. Hoistway 20 also provides a space to mount guide rails 40 and hydraulic jacks 50. Additionally, hoistway 20 is shown as including a pit 22. Pit 22 is a space below the lowest vertical translation point of elevator car 30. As can be seen, pit 22 is configured to house power unit 100 and other components of hydraulic elevator system 10. In this fashion, power unit 100 may be located under elevator car 30. It will be understood that other types of elevator systems are contemplated. In operation, the car 30 does not enter the pit 22.

Figure 2A:
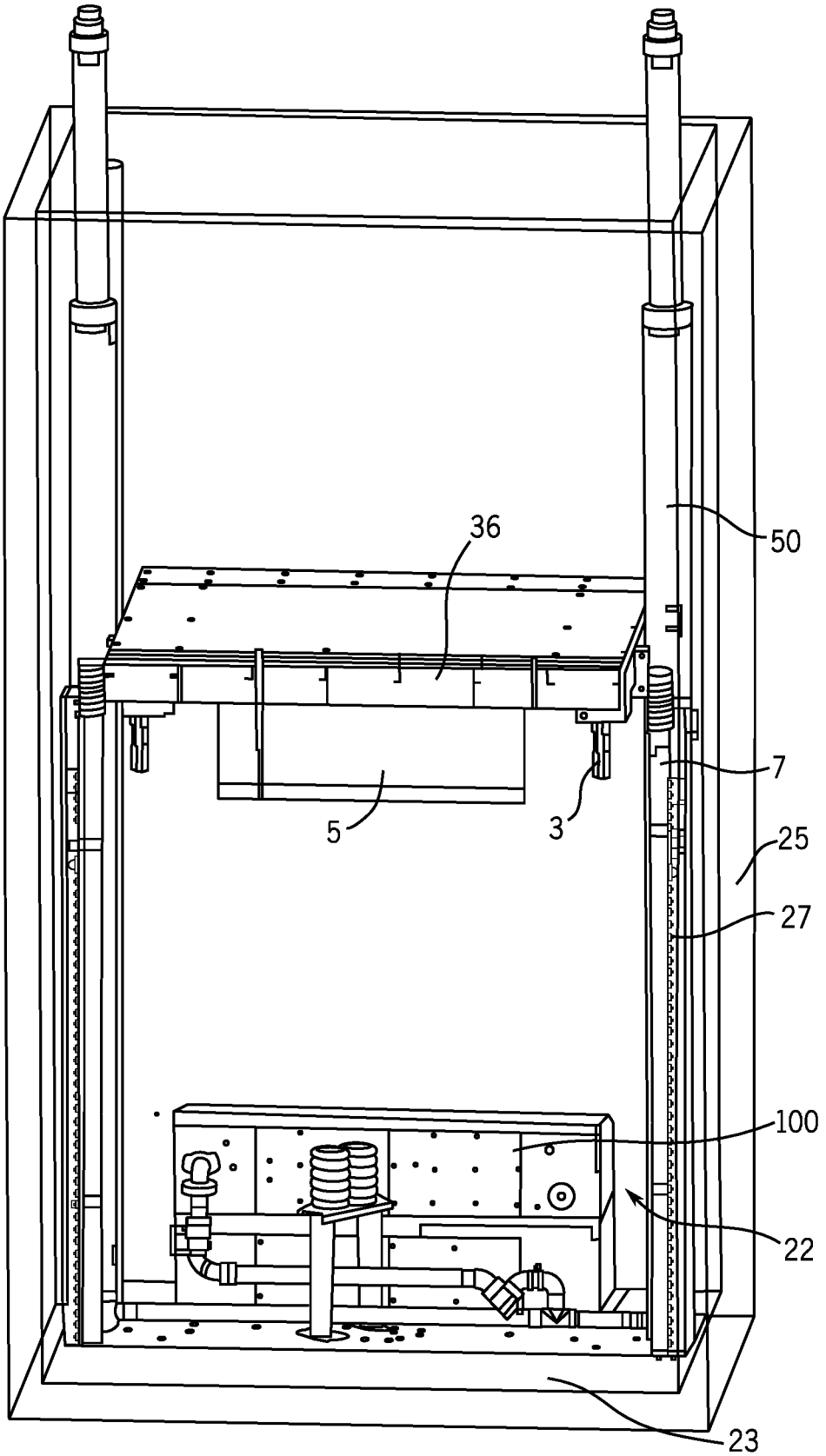
FIG. 2A is isometric view of an elevator system with the elevator car not shown.
Figure 2B:
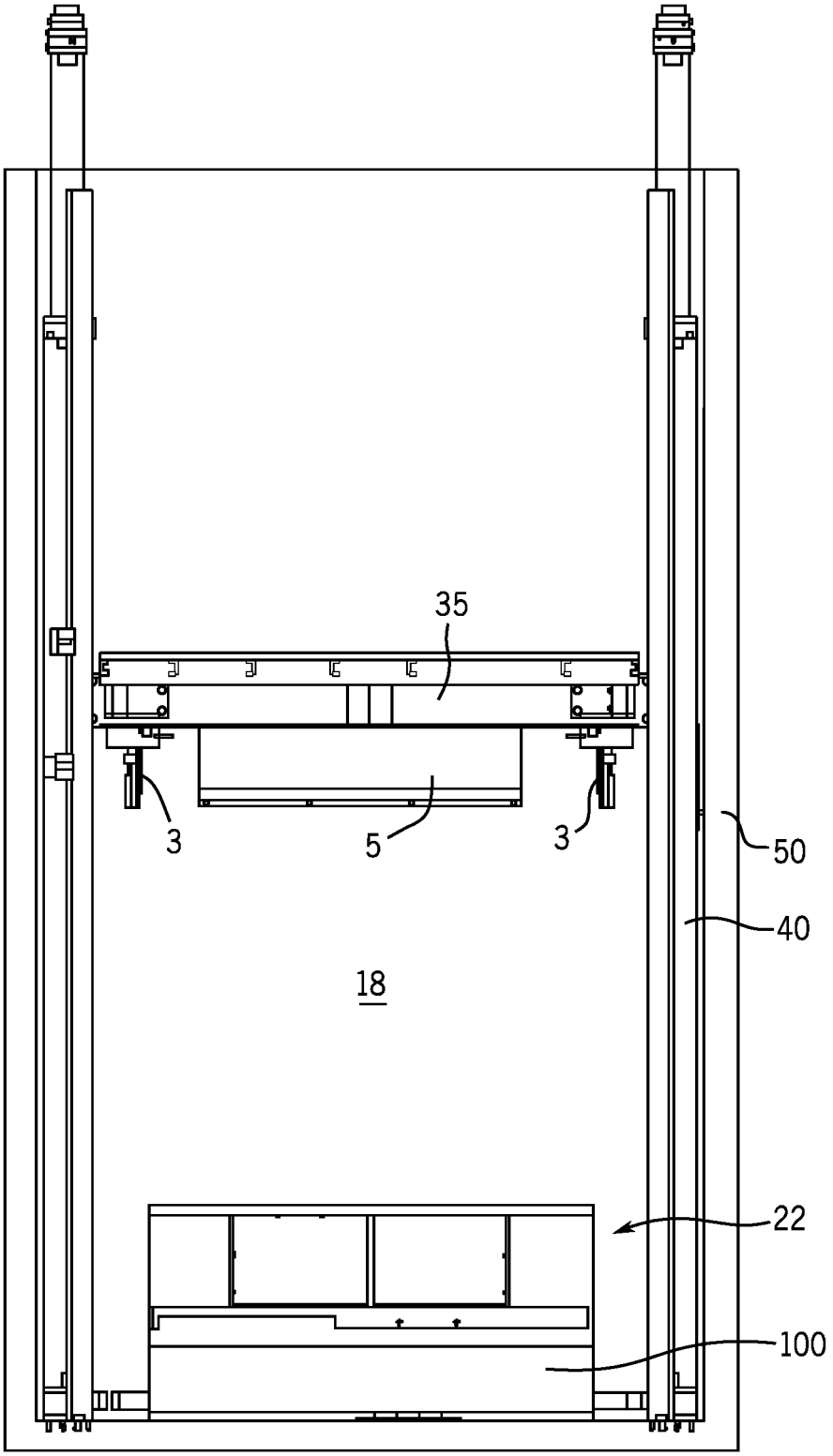
FIG. 2B is a rear view of an elevator system with the elevator car not shown.

FIGS. 2A-2B depict a flapper mechanism or blocking apparatus 3 mounted to a bolster channel 35 of the car frame 34 and a pit prop device 7 installed in the hoistway pit 22. The flapper mechanism 3 and pit prop device 7 work in conjunction to create a refuge area 18 beneath the elevator frame and above and including the pit 22. The refuge area 18 is created and maintained when the flapper mechanism 3 is deployed and permitted to come into contact with the pit prop device 7. Thus, the elevator car 30 is maintained at a position within the hoistway 20 at a sufficient height to allow a technician to safely perform maintenance operations within the elevator pit 22 on features of the elevator system in the pit and refuge area 18.

In some embodiments, the height of the refuge area is greater than the height of the elevator pit. In some embodiments, during normal operation of the elevator system, elevator car 30 is capable of vertically translating along at least a portion of the height of the refuge area. Flapper mechanism 3 and pit prop device 7 are designed to support the full weight of the elevator car 30 should the need arise and are also configured to retard movement of the elevator car and optionally also provide a soft landing of the elevator car and otherwise control potential energy of the elevator car.

Figure 3:
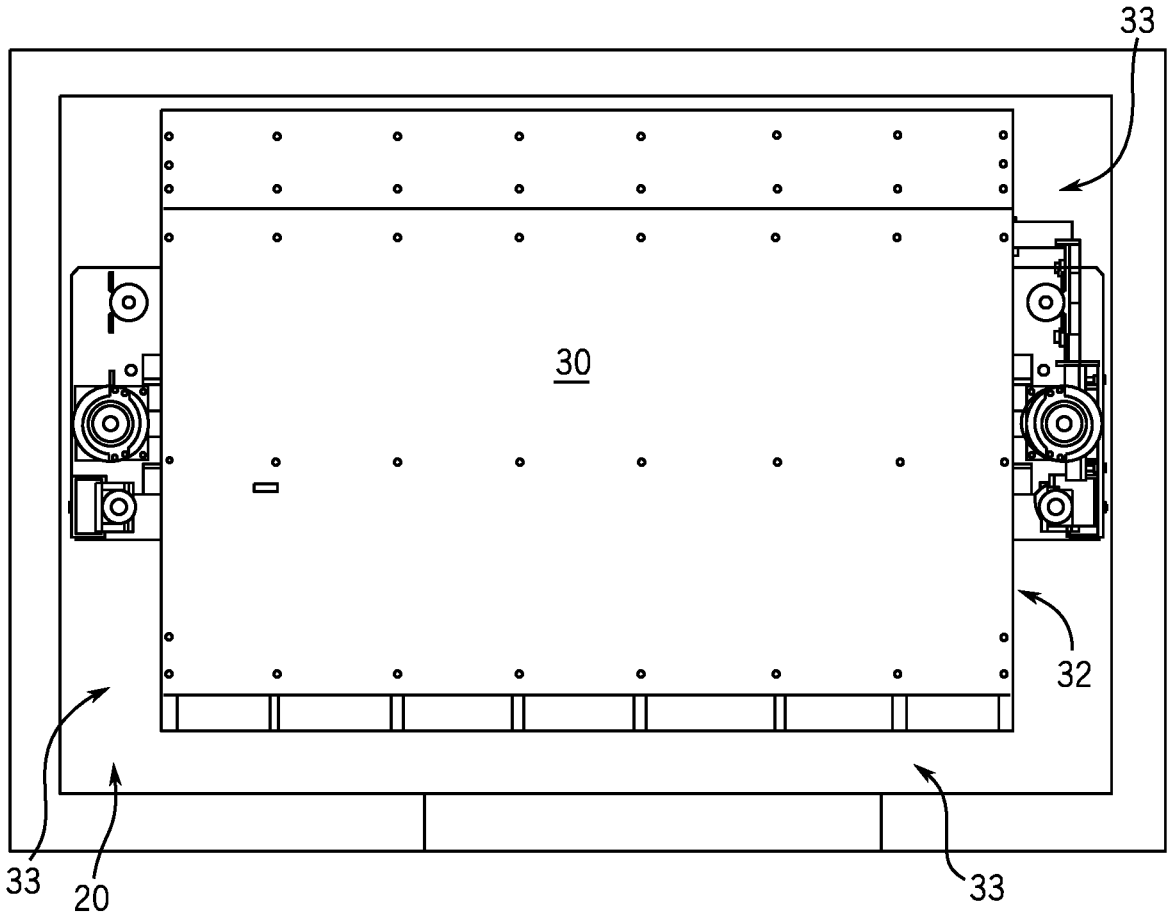
FIG. 3 is a top view of an elevator system.

FIG. 3 shows, looking downwardly from above the car 30 and the position of the car within the hoistway 20. The car has an outer periphery 32. The space 33 created between the outer periphery 32 and the inner walls of the hoistway 20 provide clearance between the car 30 and the hoistway 20 and provides room for structural features of the elevator system 10 as is well known.

Figure 4A:
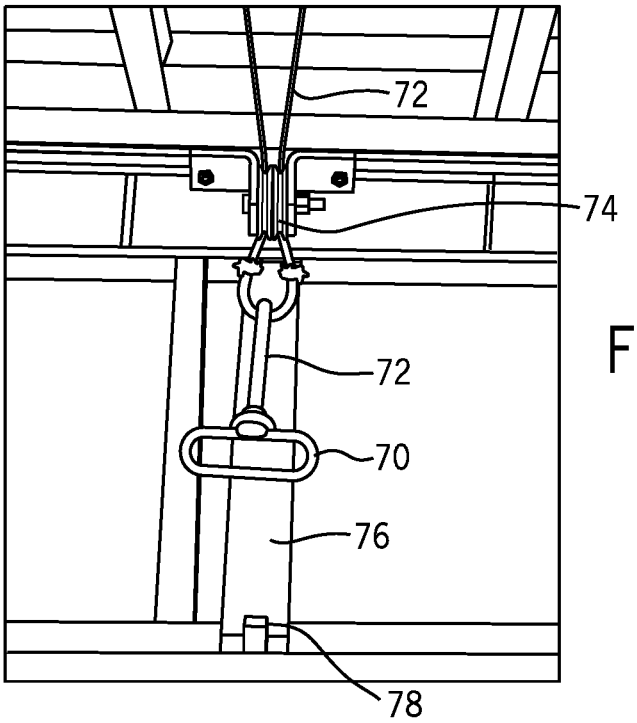
FIG. 4A is a view of an unlatched undeployed handle for the blocking apparatus.
Figure 4B:
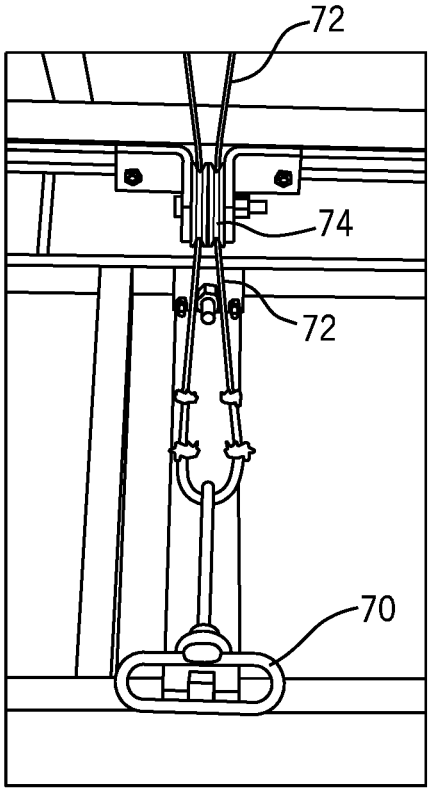
FIG. 4B is a view of a latched deployed handle for the blocking apparatus.
Figure 4C:
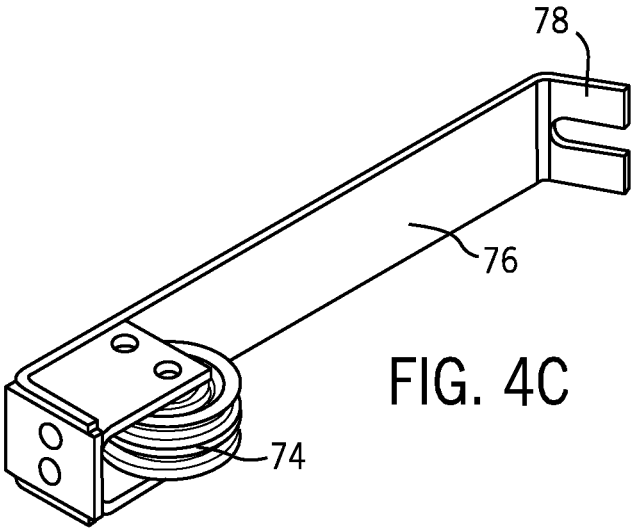
FIG. 4C is a perspective view of an embodiment of a combined handle latch and pulley assembly.

Turning to FIGS. 4A-C, the flapper mechanism 3 may be deployed and retracted manually by way of a cable actuation, for example via a handle 70, which is connected to the flapper mechanism via a cable 72. The cable 72 may be a conventional steel cable that is directed over a pulley 74 mounted to a bracket 76. In FIGS. 4A-B, the bracket 76 is mounted to an underneath of the car 30, for example, on a structural member of the car, e.g., a bolster 35, or any suitable part of the car. Accordingly, the handle 70 is accessible from a position underneath or adjacent the car 30 and may be pulled downwardly or sideways to pull the cable 72 or release the cable. In the configuration shown, the handle 70 may be latched to or released from a catch 78 formed on an end of the bracket 76. The catch 78 may be any shape that is suitable to retain the handle 70, such as a forked shape to capture the handle.

When the handle 70 and therefore the cable 72 is pulled, the flapper mechanism 3 is deployed, which enables the flapper mechanism to interact with the pit prop device 7 and this interaction supports the position of the car 3 in the hoistway 20. The rod 80 may be pivotally connected to the elevator car 30 and provided with a stop 82 that contacts the rod in the deployed position to enable the rod to contact the prop device 7 and bring the car 30 to a stop in a desired position in the hoistway 20. The rod 80 or arm, may be a tubular, rectangular structural member made of steel or any suitable material or shape.

The handle 70 may be fixed in the pulled position (FIG. 4B) with the flapper 3 deployed, and the handle is shaped and sized to be latched to the catch 78 to maintain tension in the cable 72 and maintain the flapper in the deployed state. Releasing the hangle from the catch 78 (FIG. 4A) untensions the cable 72 whereupon the flapper mechanism can be retracted.

Figure 5A:
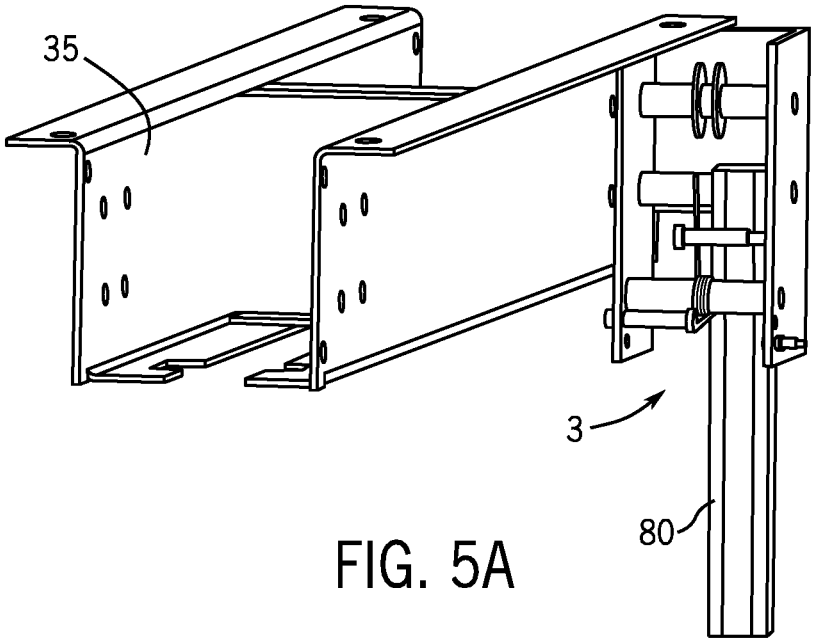
FIG. 5A is an isometric view of a blocking assembly in an inactive or undeployed position.
Figure 5B:
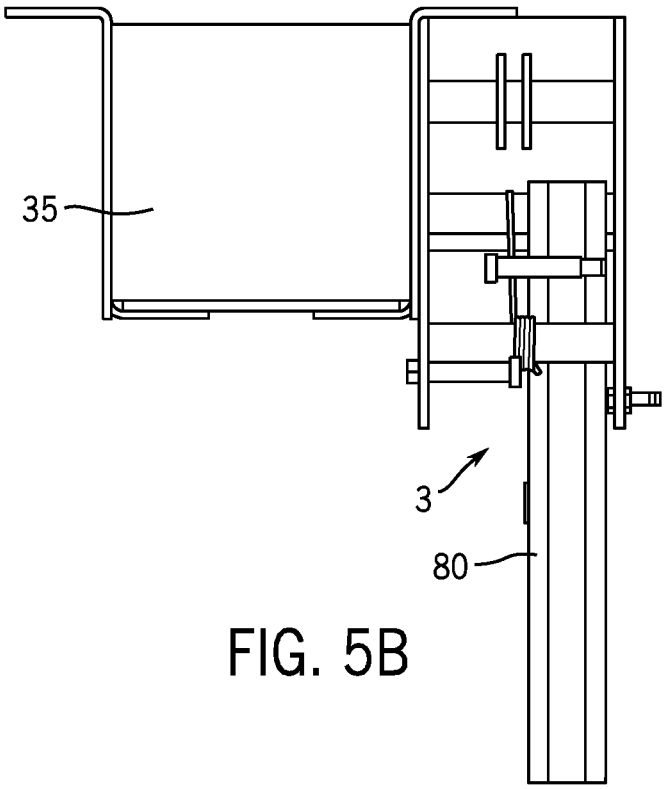
FIG. 5B is a first side view of a blocking assembly in an inactive or undeployed position.
Figure 5C:
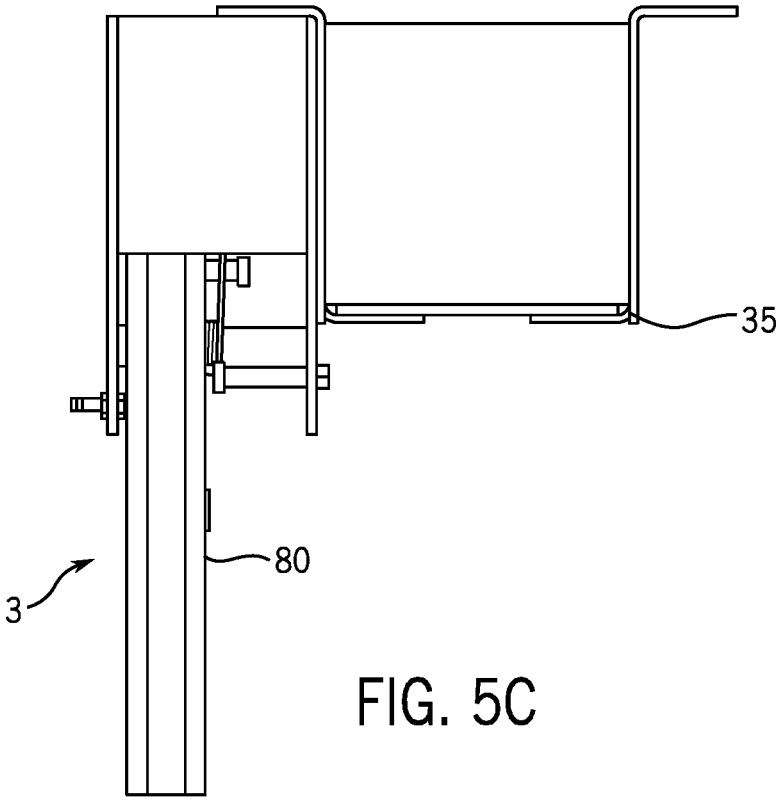
FIG. 5C is a second side view of a blocking assembly in an inactive or undeployed position viewed from the side opposite that of FIG. 5B.
Figure 6:
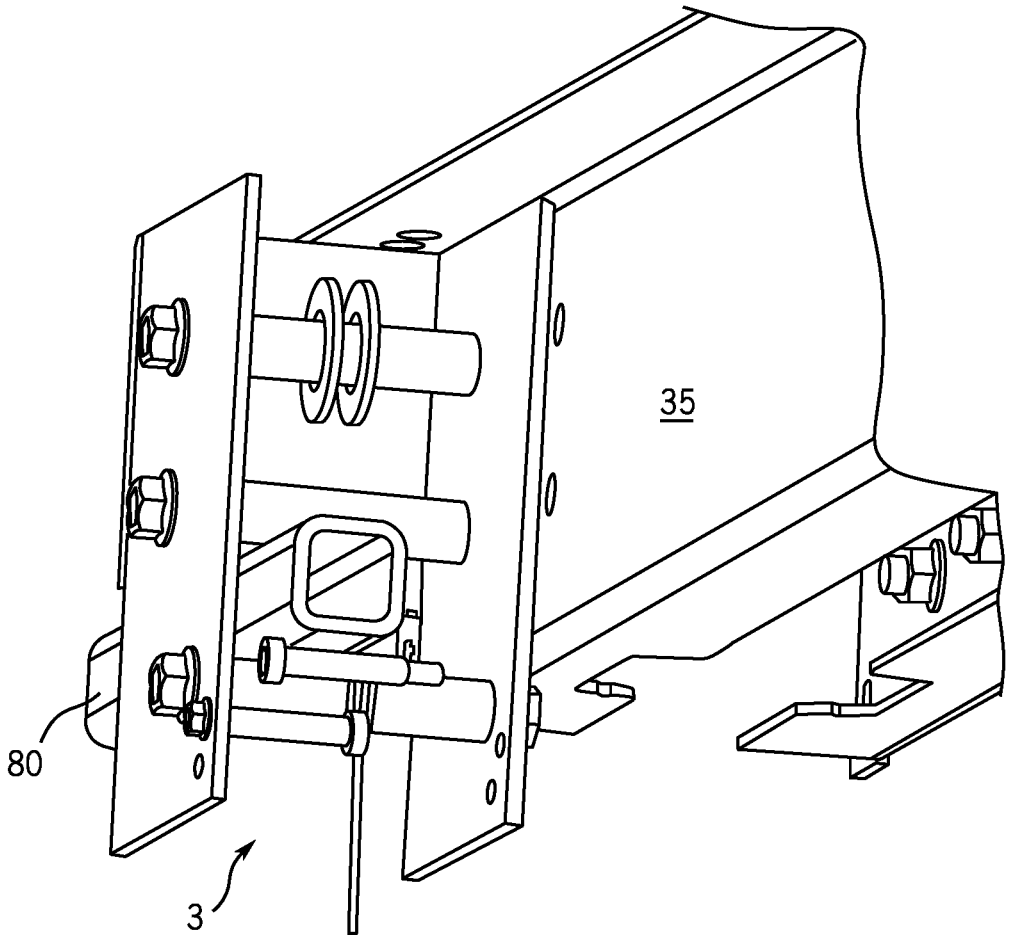
FIG. 6 is an isometric view of the blocking assembly in an activated or deployed position.

Structurally, the flapper mechanism 3 includes a safety rod or arm 80 and is configured such that each safety rod, when there are multiple flapper mechanisms, pivots between a retracted, vertical position as seen in FIGS. 5A-5C and a horizontal, extended or deployed position as seen in FIG. 6.

Figure 7:
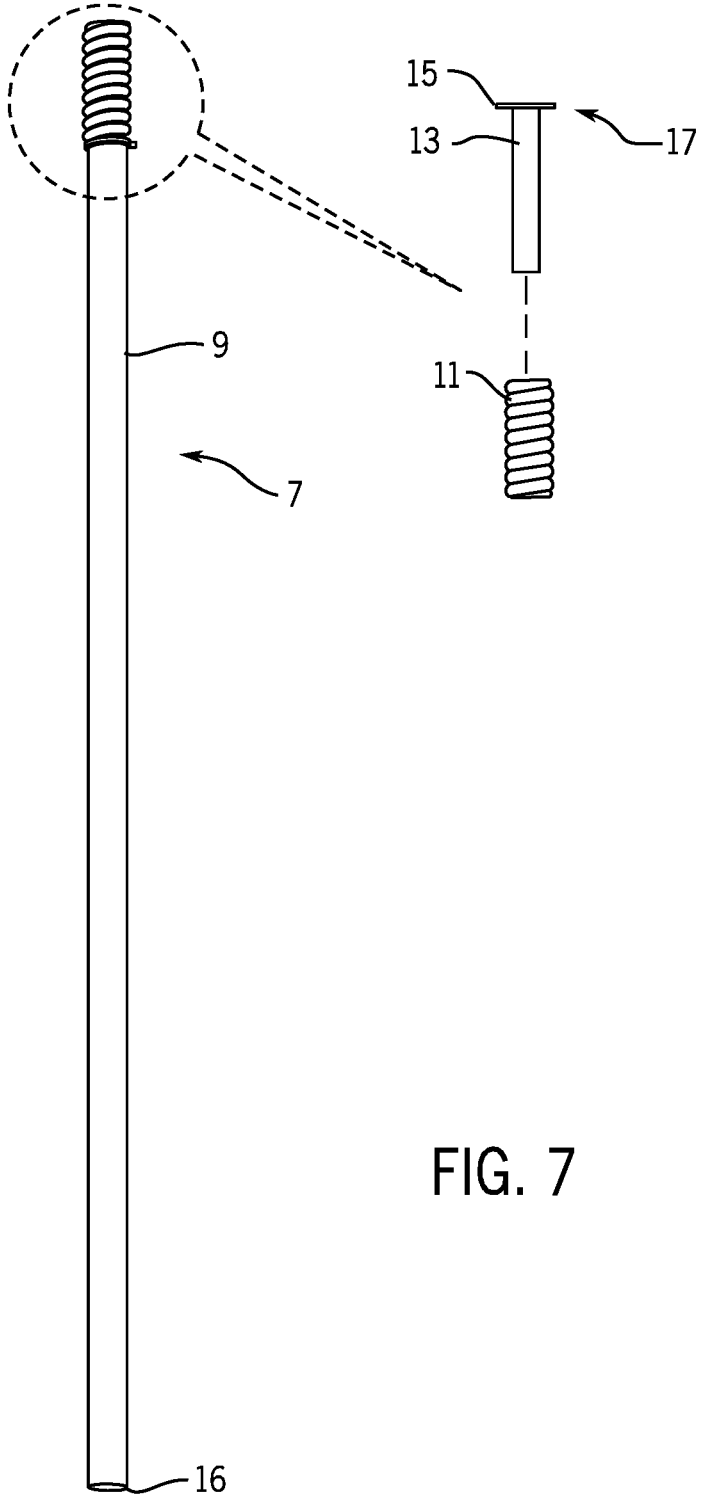
FIG. 7 is a side view of a pit prop device.
Figure 8:
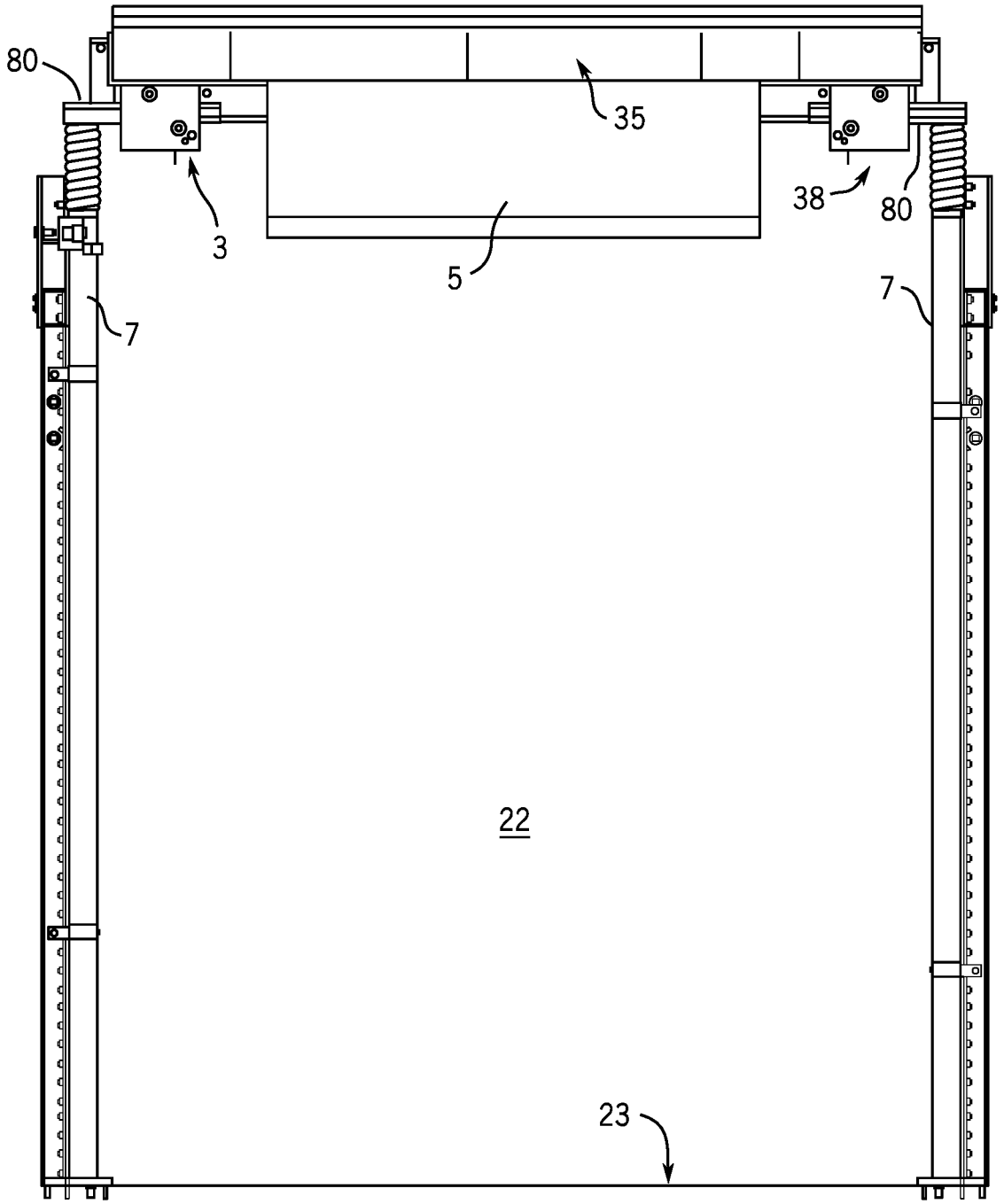
FIG. 8 is a side view illustrating safety rods of the blocking assembly deployed and in contact with the top plate of the pit prop device.

Referring to FIG. 7 and FIGS. 1 and 2A, the pit prop device 7 may extend vertically upward from the pit floor 23 and may be attached to the hoistway wall 25. In some embodiments, the pit prop device 7 may be attached to a lower most stage of hydraulic jack 50. In other embodiments, the pit prop may be attached to the elevator guide rail 40. In some embodiments, pit prop device 7 is attached to the hoistway wall 25 by a support rail 27.

The pit prop device 7 may include a support pipe 9, having a lower end 16 and an upper end 17 opposite the lower end, a spring 11 disposed at or near the upper end, a spring support 13, and a pit prop top plate 15 at the upper end. The support pipe 9 may be made of steel or any suitable material and may be any suitable shape, such as circular, tubular, rectangular and so on.

The spring 11 is attached to or resides upon or around the spring support 13. The spring 11 may be a coil spring made of spring steel, for example. The spring 11 may be disposed on top of the pipe 9 and under the plate 15, such that the spring biases the spring support (and thus the top plate 15) upwardly from the pipe. The spring support 13 may be slidably disposed in a hollow center of the pipe 9 such that the top plate forms a movable, spring biased cushion upon which the car 30 may rest upon contact.

In alternative embodiments, spring 11 and spring support 13 may be mounted below support pipe 9. Alternative retardation or biasing devices may be used in place of spring 11. In another example, pit prop device 7 can be designed to bend or flex when it receives a load.

When the safety rod 80 is in the extended position, the safety rod extends beyond the elevator car 30 and the car periphery 32 (see FIG. 3) such that it is extended outwardly from the car periphery 32 and above the top plate 15 of pit prop device 7. Downward movement of the elevator car 30 past the pit prop device 7 is arrested by contact of the safety rod and the top plate 15, when the safety rod is in the extended or deployed position. When the safety rod 80 is in the retracted position, the safety rod and the pit prop device 7 are prevented from engaging because the rod is retracted within the car periphery and cannot engage with the prop device. When retracted, the state of no contact between the safety rod 80 and the prop device 7 permits travel of the elevator car 30 into the refuge area below the top plate 15 of the prop device.

In some embodiments the flapper mechanism 3 may be actuated mechanically. Actuation of the flapper mechanism 3 may include a combination of gravity and springs. In some embodiments, the flapper mechanism 3 may incorporate a retardation or force biasing member of device (e.g., a structural member that flexes, bends, or helically compresses/decompresses (i.e., a spring)). In other embodiments, the flapper mechanism 3 may be actuated electromechanically via a circuit comprising a solenoid or some other electromechanical apparatus.

The refuge area may be created without a technician having to enter the elevator pit 22 because the handle 70 is accessible from a safe position. When preparing for maintenance of the elevator system 10, a technician moves the elevator car 30 in an inspection mode so that the bottom of a toe guard 5 attached to a frame 34 of the elevator car 30 is accessible via a lowest-most building floor or landing 36, e.g., 5-6 ft. above floor sill. The technician may then reach the back of the toe guard 5 and locate handle 70 which may be moveably attached to the toe guard 5. The technician will pull the handle 70 downward and fasten it to latch 78 provided on the bracket 76 which is attached to the toe guard. Actuation of this handle 70 causes the safety rod 80 of flapper mechanism 3 to move from an inactive or retracted position to an active or deployed position. The technician may visually verify that swing or safety arms 80 of the flapper mechanisms 3 are fully in the active position and are aligned with springs 11 of the pit props 7. The technician will then lower the car until it stops by interaction of the pit props 7 and swing arms 80. The technician will then visually verify that the arms 80 of the flapper mechanisms 3 are in contact with the springs 11 or top plate 15 of the pit props 7 and that the elevator car 30 has come to a fully supported stop.

In operation, for example after inspection and/or maintenance has been completed the following steps may be executed to return the elevator car 30 into a state permitting operation of the system 10, including: a) raising the elevator car 30 using hoistway access until the bottom of the toe guard 5 is about 5-6 feet above the floor sill and the flapper mechanism 3 is decoupled from the pit props 7, b) reaching under the toe guard 5 below the arrow and locating the handle 70 for the flapper mechanism 3, c) pulling the handle (e.g., downward and away from the toe guard) to release the handle mechanism, allowing the handle to come to rest above the latch, d) verifying that the swing arms 80 of the flapper mechanisms 3 are clear of the pit props 7 and in an undeployed state, i.e., resting and secured in an horizontal orientation. After the flapper mechanism 3 is confirmed as being undeployed, the elevator car 3 and operating system 60 may be permitted to resume operations.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A travel blocking apparatus for blocking the movement of a car movably disposed in a hoistway, the travel blocking apparatus comprising:

a flapper mechanism attached to the car and configured, when deployed, to extend an arm outside of an outer side periphery of the car;

a prop device disposed in the hoistway and configured to contact the arm when said arm is extended so as to stop the car from moving downwardly in the hoistway;

a cable attached to the arm, which, when tensioned, is configured to move the arm into a deployed state; and a handle attached to the cable and disposed at least one of underneath or adjacent the car, and configured to permit a user to access the handle from a position outside the hoistway and tension the cable when the handle is pulled by the user.

2. The travel blocking apparatus of claim 1 wherein the arm is configured to pivot.

3. The travel blocking apparatus of claim 2 wherein the arm, when deployed, is horizontal.

4. The travel blocking apparatus of claim 2 wherein the arm, when retracted, is vertical.

5. The travel blocking apparatus of claim 1 wherein the arm comprises an elongate tube pivotally mounted to a frame member of the car.

6. The travel blocking apparatus of claim 1, further comprising an electromechanical apparatus attached to the cable and configured to tension the cable by electromechanical actuation without the need to manually pull the handle.

7. The travel blocking apparatus of claim 1 wherein the prop device includes a rigid tube affixed to a sidewall of the hoistway.

8. The travel blocking apparatus of claim 7 wherein the prop device extends into a pit area of the hoistway.

9. The travel blocking apparatus of claim 8 wherein the prop device includes an upper end comprising a biasing element.

10. The travel blocking apparatus of claim 9 wherein the biasing element is a coil spring.

11. The travel blocking apparatus of claim 10 wherein the prop device further includes a spring support movably disposed at the upper end, the spring support configured to support the spring thereon.

12. The travel blocking apparatus of claim 11 wherein the spring support further comprises a plate affixed thereto at an upper end of the prop device, the spring support and plate configured to retain the coil spring atop the tube portion of the prop device.

13. The travel blocking apparatus of claim 12 wherein the plate is disposed so as to contact the arm of the flapper mechanism when the arm is extended.

14. The travel blocking apparatus of claim 13 wherein the coil spring and spring support is configured to cushion movement of the car when the arm is extended upon contact.

15. The travel blocking apparatus of claim 1 wherein when the flapper mechanism is deployed and the car is positioned so as to permit contact of the arm with the prop device a refuge is maintained in the hoistway under the car.

16. The travel blocking apparatus of claim 15 wherein the refuge is sized and shaped to permit access thereto.

17. An elevator system, comprising:

a hoistway;

an elevator car configured to move vertically within the hoistway;

a flapper mechanism attached to the elevator car and configured, when deployed, to extend an arm outside of an outer side periphery of the car;

a prop device disposed in the hoistway and configured to contact the arm when said arm is extended so as to stop the car from moving downwardly in the hoistway;

a cable attached to the arm, which, when tensioned, is configured to move the arm into a deployed state; and a handle attached to the cable and disposed at least one of underneath or adjacent the car, and configured to permit a user to access the handle from a position outside the hoistway and tension the cable when the handle is pulled by the user, wherein the flapper mechanism and the prop device are disposed so as to maintain a refuge area within the hoistway underneath the elevator car.

18. The elevator system of claim 17 wherein the refuge area is sized and shaped to permit access thereto.

* * * * *